US005743510A

United States Patent [19]

Johnston

[11] Patent Number: 5,743,510

[45] Date of Patent: Apr. 28, 1998

[54] SELF-ALIGNING MOLD BOX ASSEMBLY

[75] Inventor: Llewellyn L. Johnston, Vancouver, Wash.

[73] Assignee: Columbia Machine, Vancouver, Wash.

[21] Appl. No.: 361,790

[22] Filed: Dec. 21, 1994

[51] Int. Cl.[6] ..... B28B 7/24

[52] U.S. Cl. ..... 249/155; 249/156; 249/158; 249/163; 249/165; 249/168

[58] Field of Search ..... 249/155, 156, 249/158, 160, 163, 165, 166, 168

[56] References Cited

U.S. PATENT DOCUMENTS

| | | | |
|---|---|---|---|
| 798,797 | 9/1905 | Johnson | 249/156 |
| 4,123,034 | 10/1978 | Crunk et al. | 249/156 |

FOREIGN PATENT DOCUMENTS 1135655 1/1985 U.S.S.R. .

OTHER PUBLICATIONS

Illustration entitled "Mold Box Assembly, 6 Block Machine, 8 × 8 × 16", Columbia Machine, 1994.

*Primary Examiner*—Thomas R. Weber

*Attorney, Agent, or Firm*—Marger, Johnson, McCollom & Stolowitz,PC

[57] ABSTRACT

A mold box for molding concrete products includes a pair of opposed substantially parallel end plates. A pair of opposed substantially parallel mounting brackets are positioned at opposite ends of the end plates and together with the end plates form a substantially rectangular mold box. A corner portion is defined adjacent the juncture of each mounting bracket with each end plate. At least one partition plate extends from one end plate to the other between the mounting brackets. An alignment pin is formed on the mounting bracket at each corner portion and an alignment bore coaxial with the pin is formed on the end plate. The bores are sized and positioned so that when each bore has its associated alignment pin therein the mold box assembly is sufficiently aligned to form molded products.

18 Claims, 2 Drawing Sheets

SELF-ALIGNING MOLD BOX ASSEMBLY

BACKGROUND OF THE INVENTION

1. Field of the Invention

The present invention relates to mold box assemblies and more particularly to such assemblies which are used to form molded products such as concrete products.

2. Description of the Related Art

Machines for forming concrete products such as blocks, bricks and pavers, typically utilize a rectangular mold box assembly in which concrete is compressed to form the product. One such machine is described in U.S. Pat. No. 5,059,110 to Allison et al. for APPARATUS FOR FORMING CONCRETE BLOCKS HAVING PLURAL SEPARATELY DRIVEN VIBRATOR SETS. A typical mold box assembly includes a pair of opposed substantially parallel upright end plates and a pair of opposed substantially parallel upright mounting brackets positioned at opposite ends of the end plates which together with the end plates form a substantially rectangular mold box. In the prior art, the mounting plates are bolted to the end plates at the four corners of the mold box.

The mold box assembly is put together prior to mounting the same on the machine. In the course of creating the mold box assembly various liners, partition plates, and cores are installed in the interior of the box depending on the type of concrete product which is to be molded therein. When the box is assembled it is mounted on the machine via bolts secured through holes in the mounting brackets on either end of the mold box assembly. The top and bottom of the mold box assembly are open so that a steel pallet which is supported on the machine can be urged against the bottom of the box while concrete is dropped into the top of the box. Thereafter a head plunger mounted on a vertically moveable portion of the machine lowers into the top of the mold box thereby compressing the concrete therein and forming the molded product. The molded product is stripped out of the box through the bottom side while continuing to be supported by the pallet.

When the mold box is assembled it is important that the end plates be at precisely ninety degrees to a steel pallet urged against the underside of the assembled mold box in order to form square product. Prior art mold boxes are assembled via nuts and bolts secured to the end plate and mounting brackets at each corner of the mold box. Typically the box is assembled with the nuts finger tight to permit use of a metal square to adjust the position of the end plate relative to a flat steel surface supporting the mold box. When the box is square, a wrench is used to securely tighten the bolts holding the box together. Such a process is time consuming and produces molded products having shapes dependant to a certain extent upon the skill of file person assembling the mold box.

It would be desireable to produce a mold box assembly which aligned itself during assembly.

SUMMARY OF THE INVENTION

A self-aligning mold box assembly in which molded products are formed includes a pair of opposed substantially parallel end plates. A pair of opposed substantially parallel mounting brackets are positioned at opposite ends of the end plates and together with the end plates form a substantially rectangular mold box. A corner portion is defined adjacent the juncture of each mounting bracket with each end plate. At least one partition plate extends from one end plate to the other between the mounting brackets. An alignment pin is formed on the mounting bracket at each corner portion and an alignment bore coaxial with the pin is formed on the end plate. The bores are sized and positioned so that when each bore has its associated alignment pin therein the mold box assembly is sufficiently aligned to form molded products.

A method for making such a mold box is also provided.

It is a general object of the present invention to provide a mold box assembly which overcomes disadvantages associated with prior art mold box assemblies.

It is a more specific object of the present invention to provide a mold box assembly which aligns itself during assembly.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
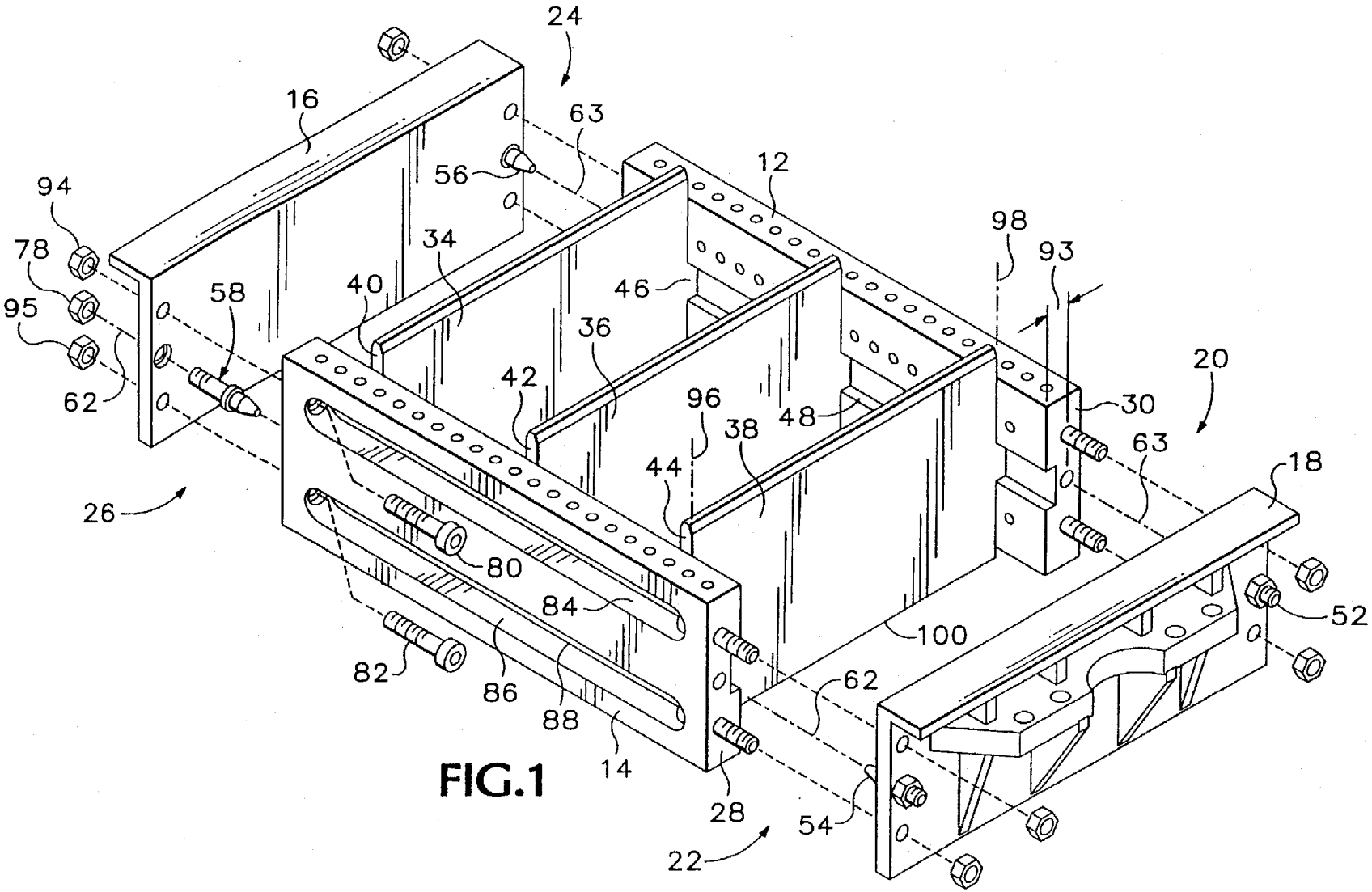
FIG. 1 is a partially exploded view of a mold box assembly constructed in accordance with the present invention.
Figure 2:
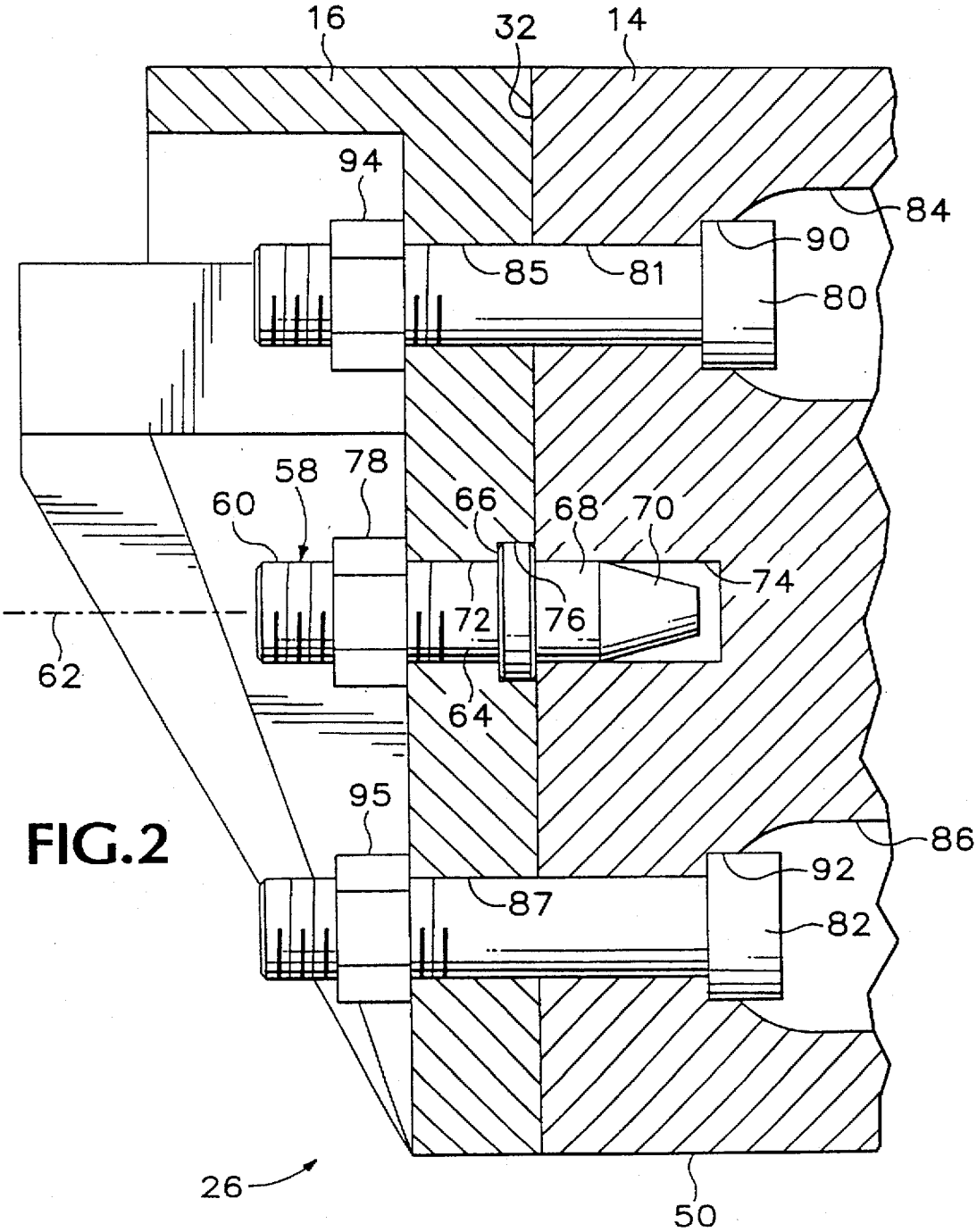
FIG. 2 is an enlarged sectional view of a portion of the mold box assembly of FIG. 1 in assembled condition.

Turning now to FIGS. 1 and 2, indicated generally at 10 in FIG. 1 is a mold box assembly incorporating the present invention. The assembly includes a pair of substantially parallel end plates 12, 14 and a pair of mounting brackets 16, 18 which together define a mold box having four corner portions indicated generally at 20, 22, 24, 26.

Each end plate includes opposing end surfaces, like end surfaces 28,30, visible in FIG. 1, and end surface 32 in FIG. 2.

Partition plates 34, 36, 38 extend between end plates 12, 14 and include end surfaces, like end surfaces 40,42,44 in FIG. 1, which flushly abut an interior side of each end plate. A tab, like tab 46 on end plate 34, is formed on each end of each end plate. The tab is received in a corresponding slot, like slot 48, formed in an interior side of each end plate. Each partition plate includes a substantially planar downwardly directed surface, one of which is surface 50 in FIG. 2, along the lower edge thereof. The lower edges of the partition plates are coplanar with the downwardly directed partition plate surfaces, like surface 50, in FIG. 2.

Each of corner portions 20, 22, 24, 26 includes an alignment pin 52,54,56,58, respectively. The alignment pins are substantially identical to one another.

In FIG. 2, pin 58 includes a threaded end portion 60 which is cylindrical and which, in the present embodiment, has a diameter of 0.621". Alignment pin 58 is coaxial about a longitudinal axis or centerline 62 and pin 56, in FIG. 1, is coaxial about a longitudinal axis or centerline 63. Pin 58 includes a tapered portion 64 which extends between threaded portion 60 and an annular shoulder 66. In the present embodiment of the invention, at its juncture with threaded portion 60, tapered portion 64 has a diameter of 0.621"±0.001" and at its juncture with shoulder 66 the tapered portion has a diameter of 0.624±0.001". A cylindrical portion 68 extends between shoulder 66 and a tapered tip 70. Cylindrical portion 68 has a diameter of 0.624"±0.001".

Pin 58 is received in a bore 72 formed through mounting bracket 16. Bore 72 is 0.625" to 0.67" in diameter and is referred to herein as an alignment pin seating bore. As will be seen, centerlines 62, 63 are substantially coaxial with the centerlines of the bores, like bore 72, in which the pins are received when the mold box is assembled and are referred to herein also as the centerlines of the alignment pin seating bores. Cylindrical portion 68 and tip 70 of the pin are received in a bore 74, which is referred to herein as an alignment bore, formed in end surface 32 of end plate 12. Bore 74 has a diameter of 0.626" to 0.627". Shoulder 66 is entirely received within a counterbore 76 to permit end surface 32 of end plate 14 to flushly abut against the surface of mounting bracket 16 shown in FIG. 2. A nut 78 is threadably engaged with threaded portion 60 of the pin. Due to the relative sizes of the taper on pin 58 and bore 72, centerline 62 of pin 58 is drawn inexorably into coaxial alignment with bore 72 as nut 78 is tightened. When the nut is fully tightened against the mounting bracket as shown, pin 58 is precisely positioned relative to mounting to bracket 16.

A pair of Allen screws 80, 82 are received in bores 81, 83 which communicate with upper and lower slots 84, 86 formed on the exterior side of end plates 12, 14. The slots do not extend through the end plate. Each slot terminates at a rear wall like rear wall 88, the lower most portion of which is visible in FIG. 1. The head of each bolt is received in a counterbore 90, 92 coaxial with bores 81, 83, respectively. Bores 85, 87 in mounting bracket 16 receive the end of the screws. Nuts 94, 95 secure the Allen screws, and thus the mold box, in position as shown. Allen screws 80, 82 are referred to herein as securing bolts.

Because certain dimensions of the structure are important to assure correct operation of the mold box, several dimensions of the preferred embodiment are provided. With reference to FIG. 1, the distance between centerlines 62, 63 of the alignment pin seating bores on mounting bracket 16 is 19.062"±0.002". The distance between the centerline of each alignment bore, like the alignment bore in corner portion 20, and the interior surface of the end plate, depicted by a double headed arrow 93 in FIG. 1, is 1,203"±0.001". The length of each partition plate from one end surface, like end surface 44, to the other, which is measured between axes 96, 98 in FIG. 1, is 16.656"+0.000"−0.003". The angle between each partition plate end surface, like end surface 44, and the partition plate lower surface, one side of which is defined by edge 100 in FIG. 1, is 90°+0.00°−0.02°.

Mold box assembly 10 is put together by first inserting alignment pins 52,54,56,58 into their associated alignment pin seating bores and bolting them into position as previously described in connection with pin 58 in FIG. 2. Thereafter end plates 12,14 are set upright on a planar metal surface and partition plates 34, 36, 38 are disposed therebetween with their tabs, like tab 46, received in the slots, like slot 48, on the end plates, as shown in FIG. 1. Thereafter, each of mounting brackets 16, 18 is urged into the position of mounting bracket 16 relative to end plate 14 of FIG. 2, i.e., each of the alignment pins is inserted into its associated alignment bore.

As a result of the dimensions from the centerline of each alignment bore to the inner surface of each end plate, as depicted by double headed arrow 94 in FIG. 1; the lengths of each partition plate as measured between axes 96, 98; the distance between centerlines 62, 63 of the alignment pins 52, 54 when fully seated in their associated mounting bracket seating bores as shown in FIG. 2; and the close tolerance for the 90° angle between the end surfaces, like end surface 44, and the lower surface of each partition plate, the end plates are substantially square relative to the metal surface supporting the mold box assembly when the pins are received in their alignment bores as shown in FIG. 2. Thereafter the Allen screws, like Allen screws 80,82 in FIG.2 are installed in the bores on end plate 14 and mounting bracket 16 and bolted via bolts 94, 96 as shown to secure the mold box together. It should be appreciated that various components known in the art such as liners and cores may be installed in addition to the partition plates in order to create a mold box assembly to produce a concrete produce of a particular size and shape.

As an alternative way of assembling the mold box, each of the alignment pins can first be bolted into position as shown in FIG. 2. Thereafter the pins can be only partially inserted into their associated alignment bores on the ends of each end plate. This leaves sufficient space between the end plates to insert a partition plate oriented substantially lengthwise relative to the mold box. Thereafter the partition plate is rotated until the partition tabs, like tab 46, are each received in their associated end plate slots as shown in FIG. 1. Then when each mounting bracket is urged against the end plates as shown in FIG. 2, the end plates are drawn into square alignment with the mounting brackets and with the metal surface upon which the mold box assembly is supported.

It can thus be seen that a mold box assembly constructed in accordance with the present invention aligns itself as the same is assembled.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A self-aligning mold box assembly in which molded products are formed comprising:

a pair of opposed substantially parallel end plates;

a pair of opposed substantially parallel mounting brackets positioned at opposite ends of the end plates which together with the end plates form a substantially rectangular mold box having a corner portion defined adjacent the juncture of each mounting bracket with each end plate;

at least one partition plate extending from one end plate to the other between the mounting brackets;

an alignment pin extending from one of said end plates and said mounting brackets at each corner portion;

an alignment bore formed on the other of said end plates and said mounting brackets at each corner portion, each alignment pin being coaxial with an associated alignment bore, said bores being sized and positioned so that when each bore has its associated alignment pin therein, the mold box assembly is sufficiently aligned to form molded products; and a pair of coaxial securing bores formed in each corner portion, one bore being formed in an end plate and the other being formed in a mounting bracket, and a bolt received in said securing bores separate from the alignment pin.

2. The mold box assembly of claim 1 wherein said mounting brackets abut against the ends of said end plates, and said bores are formed on each end of said end plates and said pins are formed on said mounting brackets.

3. The mold box assembly of claim 2 wherein the partition plate has a length sufficient to prevent rotation of each end plate about a longitudinal axis thereof when the partition plate extends from one end plate to the other between the mounting brackets and each alignment pin is received in its associated bore.

4. The mold box assembly of claim 2 wherein the centerlines of the alignment pins in each of the mounting brackets are spaced to cause the ends of each partition plate to flushly abut the end plates when the partition plate extends from one end plate to the other between the mounting brackets and each alignment pin is received in its associated bore.

5. The mold box assembly of claim 1 wherein said partition plate includes machined ends which are formed at a 90° angle to the sides thereof.

6. The mold box assembly of claim 1 wherein said mold box assembly further includes an alignment pin seating bore for receiving each alignment pin and wherein one end of each alignment pin includes a taper of a size sufficient to wedge the alignment pin into its associated seating bore when the pin is inserted therein.

7. The mold box of claim 6 wherein said mold box assembly further includes a thread formed on one end of each alignment pin and a nut for drawing the pin into wedging engagement with its associated seating bore when the pin is received therein and the nut is screwed onto the pin.

8. A self-aligning mold box assembly in which molded products are formed comprising in assembled condition:

a pair of opposed substantially parallel end plates;

an end surface formed on the end of each plate;

first mounting bracket having a side surface which flushly abuts two of the end surfaces formed on the end plates;

a second mounting bracket having a side surface which flushly abuts the other two end surfaces formed on the end plates, said mounting brackets and end plates forming a substantially rectangular mold box having a corner portion defined adjacent the juncture of each mounting bracket with each end plate;

at least one partition plate extending from one end plate to the other between the mounting brackets;

an alignment pin extending from said mounting bracket at each corner portion;

an alignment bore formed in each end surface of said end plates and being coaxial with an associated alignment pin, said bores and pins being sized and positioned so that when each bore has its associated alignment pin therein, the mold box is sufficiently aligned to form molded products; and a pair of coaxial securing bores formed in each corner portion, one bore being formed in an end plate and the other being formed in a mounting bracket, and a bolt received in said securing bores separate from the alignment pin.

9. The mold box assembly of claim 8 wherein the partition plate has a length sufficient to prevent substantially all rotation of each end plate about a longitudinal axis thereof when the partition plate extends from one end plate to the other between the mounting brackets and each alignment pin is received in its associated bore.

10. The mold box assembly of claim 8 wherein the distance between the centerlines of the alignment pins in each of the mounting brackets are spaced to cause the ends of each partition plate to flushly abut the end plates when the partition plate extends from one end plate to the other between the mounting brackets and each alignment pin is received in its associated bore.

11. The mold box assembly of claim 8 wherein said partition plate includes machined ends which are formed at a 90° angle to the sides thereof.

12. The mold box assembly of claim 8 wherein said mounting brackets further include an alignment pin seating bore for each alignment pin and wherein one end of each alignment pin includes a taper of a size sufficient to wedge the alignment pin into its associated seating bore when the pin is inserted therein.

13. The mold box of claim 12 wherein said mold box assembly further includes a thread formed on one end of each alignment pin and a nut for drawing the pin into wedging engagement with its associated seating bore when the pin is received therein and the nut is screwed onto the pin.

14. A self-aligning mold box assembly in which molded products are formed comprising in assembled condition:

a pair of opposed substantially parallel end plates;

an end surface formed on the end of each plate;

a first mounting bracket having a side surface which flushly abuts two of the end surfaces formed on the end plates;

a second mounting bracket having a side surface which flushly abuts the other two end surfaces formed on the end plates, said mounting brackets and end plates forming a substantially rectangular mold box having a corner portion defined adjacent the juncture of each mounting bracket with each end plate;

at least one partition plate extending from one end plate to the other between the mounting brackets;

an alignment pin which includes a threaded portion disposed adjacent one end of said pin and a tapered tip portion disposed adjacent its other end, and which pin further includes a tapered central portion intermediate said threaded portion and said tapered tip portion, wherein the diameter of the pin at the interface of the tapered central portion and the threaded portion is smaller than the diameter of the pin at the interface of the central tapered portion and the tapered tip portion;

an alignment seating bore disposed in said mounting brackets for receiving the tapered central portion of each alignment pin upon insertion therethrough of said alignment pin; and an alignment bore disposed in each end surface of said end plates and being coaxial with an associated alignment pin, said bores and pins being sized and positioned so that when each bore has its associated alignment pin therein, the mold box is sufficiently aligned to form molded products.

15. The mold box of claim 14 wherein said mold box assembly further includes a nut for drawing the pin into snug engagement with its associated seating bore when the pin is received therein and the nut is screwed onto the pin.

16. The mold box of claim 14 wherein said alignment pin further includes a shoulder disposed intermediate said tapered central portion and said tapered tip portion, and a bore disposed in said mounting brackets for accommodating said shoulder.

17. The mold box assembly of claim 1 wherein the mold box assembly further includes a second pair of coaxial securing bores formed in each corner portion, one bore being formed in an end plate and the other being formed in a mounting bracket, and a bolt received in each of said second pair of coaxial securing bores.

18. The mold box assembly of claim 17 wherein said end plates include upper and lower slots formed along a substantial length thereof, each bolt received in said coaxial securing bores including a head received within a counterbore intermediate said slot and coaxial with said securing bores.

* * * * *